United States Patent [19]

Podgers et al.

[11] Patent Number: 4,770,317

[45] Date of Patent: Sep. 13, 1988

[54] AUTOMATIC OVERFILL PREVENTION SYSTEM

[75] Inventors: Alexander R. Podgers, Lake City; Eric J. Butterfield, Fairview, both of Pa.

[73] Assignee: Emco Wheaton, Inc., Conneaut, Ohio

[21] Appl. No.: 49,972

[22] Filed: May 15, 1987

[51] Int. Cl.[4] ..... B65B 3/06

[52] U.S. Cl. ..... 220/86 R; 141/1; 141/86

[58] Field of Search ..... 137/234.6, 386, 389, 137/390, 393, 599.2; 141/1, 86, 209; 220/86 R

[56] References Cited

U.S. PATENT DOCUMENTS

| | | | |
|---|---|---|---|
| 1,212,102 | 1/1917 | Pipe | 137/599.2 |
| 2,351,775 | 6/1944 | McMurry | 137/599.2 |
| 4,040,455 | 8/1977 | Swain et al. | 141/225 |
| 4,278,115 | 7/1981 | Briles et al. | 138/89 X |
| 4,593,714 | 6/1986 | Madden | 141/86 X |
| 4,615,362 | 10/1986 | Hartman et al. | 141/86 |
| 4,659,251 | 4/1987 | Petter et al. | 141/86 X |
| 4,696,330 | 9/1987 | Raudman et al. | 141/86 |

*Primary Examiner*—Mark J. Thronson

*Attorney, Agent, or Firm*—Pearne, Gordon, McCoy & Granger

[57] ABSTRACT

An automatic overfill prevention system for gravity filling of an underground liquid storage tank from a tank truck fill line provides a venturi in the fill line creating a partial vacuum which is vented from the liquid storage tank through a vent line until the liquid in the storage tank rises to a predetermined level to submerge one end of the vent line and trigger a latching means to close the fill line. The assembly also includes a containment manhole to hold any inadvertent spillage occurring during the filling process.

9 Claims, 4 Drawing Sheets

AUTOMATIC OVERFILL PREVENTION SYSTEM

BACKGROUND OF THE INVENTION

1. Field of the Invention

This invention relates to a system for gravity filling of liquid storage tanks, and in particular to a liquid storage tank system incorporating an automatic shut-off mechanism which prevents overfilling the storage tank.

2. Description of the Prior Art

Considerable difficulty has been experienced in the past in attempting to prevent the overfilling of underground storage tanks at gasoline service stations. Overfilling and the resulting spillage has been a common occurrence during the gravity filling of underground storage tanks. This spillage is wasteful, hazardous, and causes environmental pollution.

Numerous attempts have been made to overcome this difficulty. However, in most of the prior structures which have been proposed, extensive modification of existing equipment has been required.

For a number of years, an automatic shut-off nozzle has been used in gasoline service stations for automatically shutting off the supply of fuel from a gasoline or other petroleum fuel pump to a vehicle when the level of liquid in the vehicle tank rises above a predetermined level. This type of nozzle is described in U.S. Pat. No. 3,196,908. In this device, a vacuum pressure is established by means of a venturi section within the nozzle. In this apparatus, however, the liquid passes through the nozzle under the pressure of the delivery pump so that no difficulty is experienced in drawing a sufficient vacuum at the venturi to activate the pressure-sensitive latching mechanism to release the closure valve when the level of liquid rises above the end of the vent line which is located within the vehicle storage tank. Although it is known that this device has operated successfully for many years, it has not been possible to employ this system when gravity filling a liquid storage tank, such as an underground storage tank, because of the velocities involved.

An attempt to incorporate the principles of the automatic shut-off nozzle into a system for gravity filling underground storage tanks was proposed in U.S. Pat. No. 4,040,455, issued to Swain et al. Swain et al. discovered that the line extending from the tank truck of the vehicle to the underground storage tank was a siphon at which at certain locations there was a significant negative pressure to draw a partial vacuum sufficient to activate the latching mechanism. This partial vacuum was utilized by extending a vent line down through the fill line, with one end of the vent line opening into the underground storage tank at a predetermined level within the tank, and the other end of the vent line communicating with a pressure-sensitive latching mechanism. A vacuum passage extended between the vent line and the fill line in order to draw a partial vacuum in the vent line. The partial vacuum would normally be vented by drawing air from within the tank until the level of liquid in the tank rose above the bottom end of the vent line, whereupon the partial vacuum would be drawn on the pressure-sensitive latching mechanism to release the latching mechanism, causing the shut-off valve to move to the closed position and interrupting the flow of liquid into the storage tank.

A major disadvantage of the system shown in the patent to Swain et al. was that it required the automatic shut-off mechanism to be installed at the end of the fill line extending from the tank truck. Thus, it was the responsibility of the tank truck operator to install the automatic shut-off mechanism on his fill line. The major advantages of automatic shut-off, however, did not primarily benefit the tank truck operator but, instead, benefited the service station operator. It was primarily the service station owner or operator who desired to prevent overflows and the resulting spills, since the spills occurred on his property, and he was primarily responsible for cleaning them up. Thus, the service station operator had a financial incentive for installing an automatic shut-off mechanism. The tank truck operator did not.

The automatic shut-off mechanism disclosed in the patent to Swain et al. had to be installed in the fill line from the truck because it relied upon the pressure drop within the fill line from one point in the tank truck fill line to the underground storage tank in order to draw a partial vacuum sufficient to activate the latching mechanism. Thus, it was not possible to install the automatic shut-off mechanism of Swain et al. as part of the underground storage tank fill structure, since the pressure drop between the tank truck fill line, which was located above ground level, and the top of the underground storage tank was essential to the operation of the mechanism of Swain et al. Yet, it is highly desirable to locate the automatic shut-off mechanism entirely with the installation at the service station rather than in the tank truck fill line. If the automatic shut-off mechanism were installed entirely on site at the service station, it would be necessary to design the mechanism so that it could be installed entirely underground, but the design of Swain et al. is unsuitable, since it cannot be installed underground.

It would also be advantageous to install such a mechanism in a containment manhole in the event that fuel or other product is spilled during the filling process. A containment manhole reduces the pollution of ground water and product spillage which may occur during the filling of the underground tank by capturing the overspill and holding it in the containment manhole. The contained product may then be removed from the manhole, or may be drained directly into the underground tank.

Examples of such containment manholes are shown in U.S. Pat. Nos. 3,633,219, issued to Byrd; 4,278,115 issued to Briles et al.; and 4,527,708, issued to Bundas et al. The Briles et al. and Bundas et al. patents show containment manholes each having a flexible seal around the riser pipe at the location at which the riser pipe enters the manhole. The Briles et al. patent also discloses a drain within the manhole through which the spilled product may be removed from the manhole. While Briles et al. disclose draining the product to a separate holding tank, the Byrd patent discloses connecting an exterior drain to the riser pipe so that spilled material may be drained directly into the riser. While these designs provide certain advantages, there are various difficulties resulting from the design of these manholes.

One problem relates to the drainage of the spilled product in the manhole from the manhole into the underground tank. Prior art designs have typically used an external hose connecting the drain in the manhole to a fitting on the riser. A flexible hose has typically been used. However, this hose is susceptible to external damage and internal blockage. Blockage could occur due to debris contained in the manhole which would be drained into the drain hose and block the drain. Damage could result during installation, or due to frost heave or settling, possibly resulting in a leak to the hose or resulting in the hose breaking or becoming disconnected from the riser. Because the manhole is externally fitted and back-filled, it is extremely difficult to remove the manhole to repair the drain hose without excavation of the entire site.

Another problem with the prior art containment manholes related to the use of the elastomeric seal to achieve integrity between the riser pipe and the opening in the manhole through which the riser extended. When the manhole moved axially due to frost heave or settling, the movement could introduce debris into the seal gland and cause damage to the seal or to the surface which the seal must act upon. If either the seal or the surface were damaged, the manhole would no longer contain liquid, since liquid could leak through the damaged seal around the riser pipe.

Another problem also related to the types of seals employed in the prior art manholes. The seals used in the prior art manholes required rather precise glands to hold the seal in a particular relationship to the seal surface. This requirement did not allow for radial movement of the manhole. The manhole might move radially due to tank settling, pavement settling, thermal expansion of the surrounding pavement, or seismic shock. Such radial movement could cause the seal gland to bind and damage the seal or the surface against which the seal acts. Furthermore, radial movement of the manhole could result in the opening in the manhole binding against the riser pipe, resulting in severe stresses transmitted through the riser pipe which could cause damage to the pipe or to the underground tank.

SUMMARY OF THE INVENTION

The present invention overcomes the difficulties of the prior art and provides advantages heretofore not achieved. The automatic overfill prevention system of the present invention is designed specifically for underground installation entirely at the service station site, eliminating the need for an automatic shut-off mechanism as part of the fill line on the tank truck. In accordance with the present invention, the required partial vacuum is achieved by creating a venturi with a reduced diameter portion at the top of the riser in the fill passage extending from the underground storage tank. This reduced diameter portion provides a throat at which the velocity of the liquid product is increased so that the necessary partial vacuum can be drawn. By increasing the level of vacuum pressure at a location beneath ground level, it is possible to install the entire automatic overfill prevention system underground on site at the service station, without the necessity of locating any portion of the mechanism above ground, and without the necessity of installing at least a portion of the system on the tank truck fill line.

In accordance with other aspects the present invention, the automatic overfill prevention system is installed underground in a containment manhole which holds any overfill or other spillage which may result during the filling process. This containment manhole also includes a drain passage so that any overfill or spilled product within the manhole can be drained into the riser. The drain passage is integrally cast with the bottom of the manhole, which is also integral with the body of the assembly which forms the automatic shut-off valve of the overfill prevention system. This integrally cast drain passage provides a liquid path which is less likely to be blocked by debris because of its increasing area and short length. In addition, the size, shape, and location of the drain passage provide easy access for cleanout. Access to the drain passage and cleanout can be provided without excavation of the site. Furthermore, the drain passage, being integrally cast with the bottom of the manhole and with the body of the shut-off mechanism, is not susceptible to damage during installation, and cannot be disconnected.

The containment manhole also provides for axial as well as radial movement of the riser pipe with regard to the top rim of the manhole. The bottom of the manhole is integrally formed with the shut-off mechanism and is rigidly attached to the riser pipe. Movement of the manhole bottom with respect to the manhole rim is provided for, and containment integrity is maintained by an expansion joint located on the sides of the manhole. This expansion joint is not susceptible to damage from debris, and is protected from internal vandalism by an inner sleeve within the manhole. Radial movement is also allowed by the expansion joint so that the transmission of stress to the underground tank through the riser pipe is prevented.

These and other advantages are achieved by the present invention of an assembly for gravity filling an underground liquid storage tank from a tank truck fill line. The assembly comprises a manhole rim adapted to be located at ground level. A cylindrical manhole housing is located below the rim. An elastomeric expansion sleeve connects the rim to the housing. The assembly also comprises a body having a liquid fill passage within the housing and below ground level for the passage of liquid under the influence of gravity. The fill passage has a narrowing venturi throat portion. The fill passage is adapted to be connected at one end to the fill line from the tank truck and adapted to be connected at the other end to the liquid storage tank. The body also has a portion forming a manhole bottom attached to the bottom of the sleeve. A drain passage is integrally formed in the manhole bottom, allowing liquid to drain from the bottom of the manhole into the fill passage. A drain valve closes the drain passage and is capable of being opened to drain liquid in the manhole bottom into the fill passage. Valve means which are provided in the fill passage are movable between an open position in which the fill passage is opened to permit the flow of liquid through the passage and a closed position in which the fill passage is closed to interrupt the flow of liquid to the storage tank. Means are provided for urging the valve means to the closed position. Pressure-responsive latch means engage the valve means and releasably lock the valve means in the open position. A vent passage has one end adapted to open in the storage tank at a predetermined level below the upper end of the tank and the other end communicating with the pressure-responsive latch means. A vacuum passage communicates between the pressure-responsive latch means and the narrowing venturi throat portion of the fill passage. The flow of liquid through the fill passage causes a partial vacuum to be formed at the narrowing throat portion. The partial vacuum is vented through the vacuum passage and the vent passage when the level of liquid in the liquid storage tank is below the level at which the end of the vent passage opens. The partial vacuum causes the pressure-responsive latch means to release the valve means when the level of liquid in the liquid storage tank rises to close the end of the vent passage. The release of the pressure-responsive latch means causes the valve means to move to the closed position by the urging means.

In accordance with another aspect of the present invention, the liquid fill passage includes a valve seat which is sealingly engaged by the valve means when the valve means is in the closed position. The narrowing venturi throat portion is formed at the valve seat.

In accordance with another aspect of the present invention, the valve means includes a pressure-responsive relief poppet portion which opens when the pressure of the liquid flow in the fill passage exceeds a predetermined level during the closing of the valve.

DETAILED DESCRIPTION OF THE PREFERRED EMBODIMENT

Figure 1:
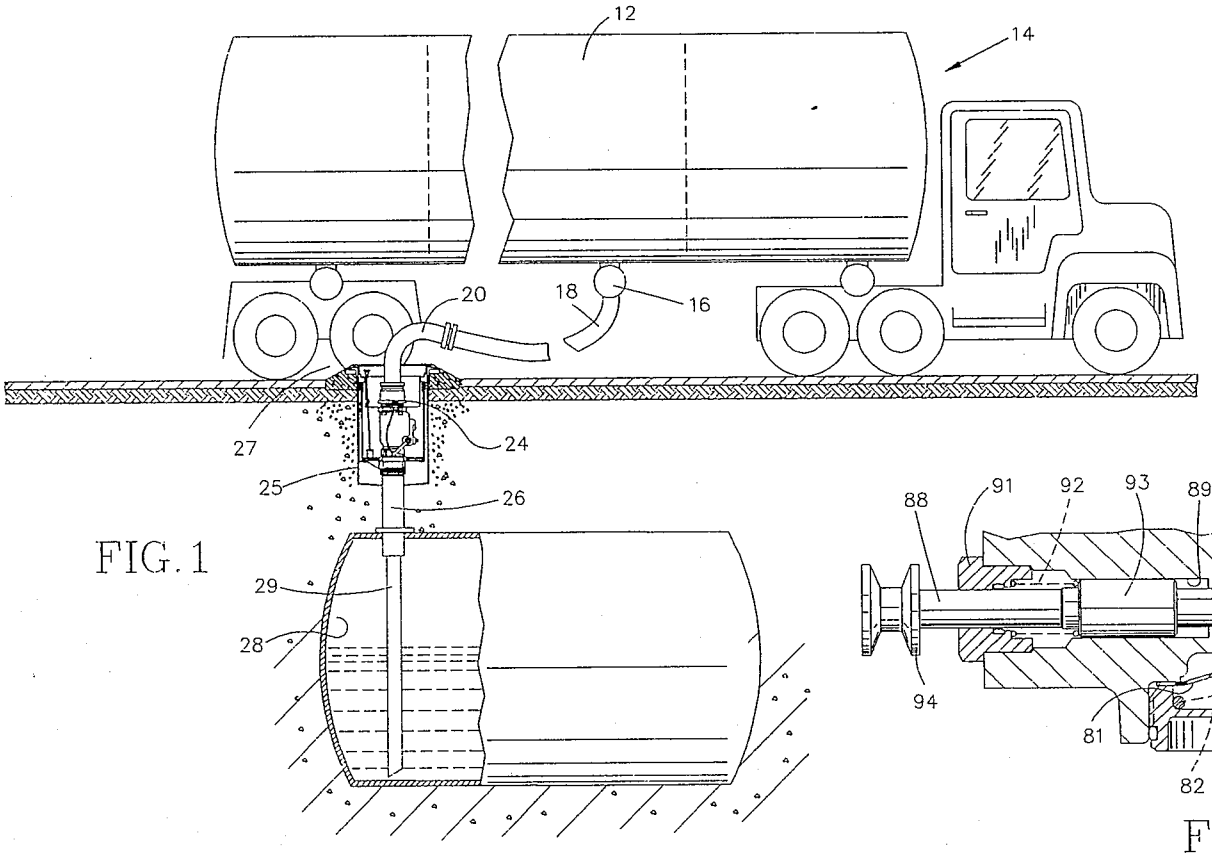
FIG. 1 is a diagrammatic illustration of liquid being discharged from a tank truck to an underground storage tank.

Referring more particularly to the drawings, and initially to FIG. 1, there is shown a liquid loading system incorporating the automatic overfill prevention system of the present invention. According to this liquid loading system, liquid from a shipping compartment 12 of a tank truck 14 is discharged through a valve 16, a filling hose 18, a coupler 20, and an adapter 24 located in an underground manhole 25. The adapter 24 is mounted on top of a riser 26 extending upwardly from the top of an underground storage tank 28. Within the riser 26 is a fill tube or drop tube 29 which lines the riser and extends from the adapter 24 to the bottom of the storage tank 28. The underground storage tank 28 is provided with a conventional vent line (not shown) which communicates between the tank 28 and the atmosphere.

This system is conventionally used in service stations where the operator must remain in attendance during the filling operation, and must close the valve 16 immediately upon determining that the underground storage tank 28 is full, or is substantially full. One way of determining whether the underground storage tank is full is through the use of an automatic signaling apparatus which has previously been developed to sense the rising level of liquid in the tank and to signal the fact that the tank is substantially full. In some prior systems, an automatic control was provided for stopping the flow of liquid when the level rose above the maximum required fill height. The present invention achieves automatic shut-off by providing a mechanism located at the top of the riser pipe 26 and formed as part of the underground manhole 25 for automatically shutting off the flow of liquid into the riser pipe when the level in the underground storage tank rises to a predetermined level.

Figure 2:
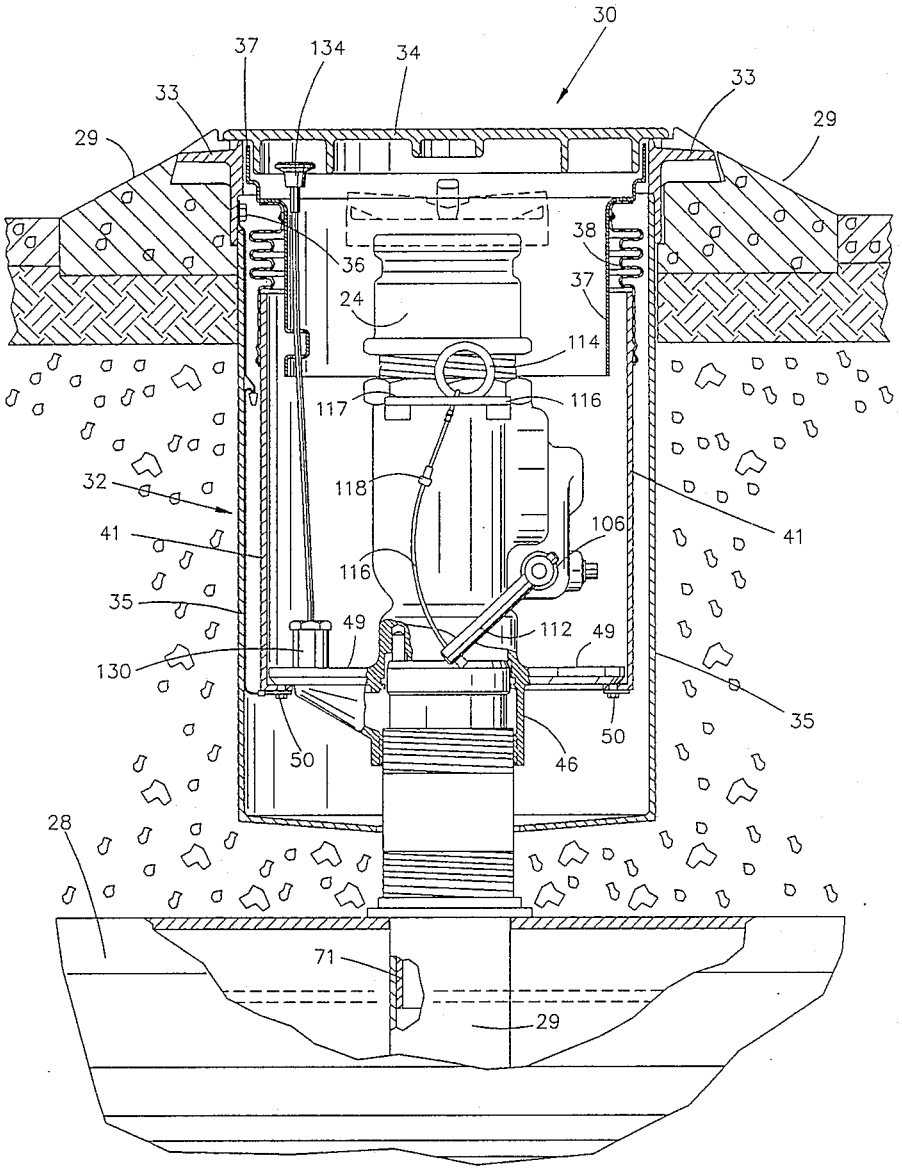
FIG. 2 is a side sectional view of the automatic overfill prevention system of the present invention shown to a greater detail than in FIG. 1.

As shown in more detail in FIG. 2, the automatic overflow prevention mechanism 30 includes a manhole assembly 32 the top of which comprises a rim 33 mounted slightly above grade level surrounding the installation, with a sloped crown 27 being formed of concrete around the rim during installation. The rim 33 is preferably mounted flush with the top of the crown. The top of the rim 33 provides support for a circular manhole lid 34 which covers the manhole assembly. An outer manhole housing 35 is attached to the bottom of the rim 33 by bolts 36. The outer manhole housing 35, which is preferably formed of plastic, forms the exterior side wall of the manhole and protects the inner portions of the manhole from gravel and other backfill material. An upper manhole sleeve 37 is mounted inside the rim 33. The lower portion of the upper sleeve 37 forms a reduced diameter portion which is spaced from the outer housing 35 and forms the upper portion of the interior side wall of the manhole. A thermoplastic elastomer expansion joint 38 is attached to the rim 33 by rivets 39. The bottom of the expansion joint 38 is attached by means of a band clamp 40 to a cylindrical manhole lower sleeve 41. The manhole lower sleeve 41 forms the lower portion of the interior side wall of the manhole. At the bottom of the manhole assembly 32, the lower sleeve 41 has an inwardly extending flange 42.

The automatic overflow prevention mechanism is incorporated within a body 45 which is located within the manhole assembly 32 and is connected to the top of the riser 26 and to the top of the drop tube 29. The body 45 includes a collar 46 having a lower fitting 47 for attachment to the top of the riser 26 and having an upper fitting 48 for attachment to the top of the drop tube 29. Extending outwardly from the top of the fitting 48 is a circular manhole bottom portion 49. The manhole bottom 49 extends outwardly to the housing 41 and is bolted to the bottom of the housing 41 by bolts 50 which extend through the flange 42 and into the periphery of the bottom portion 49. An integral drain 51 is formed in the bottom 49. The drain 51 includes an opening 52 formed in the manhole bottom 49. Liquid in the bottom of the manhole is drained through the opening 52, into the drain 15, and into the riser 26. The lower end of the drain 51 connects with the top of the riser 26.

Figure 3:
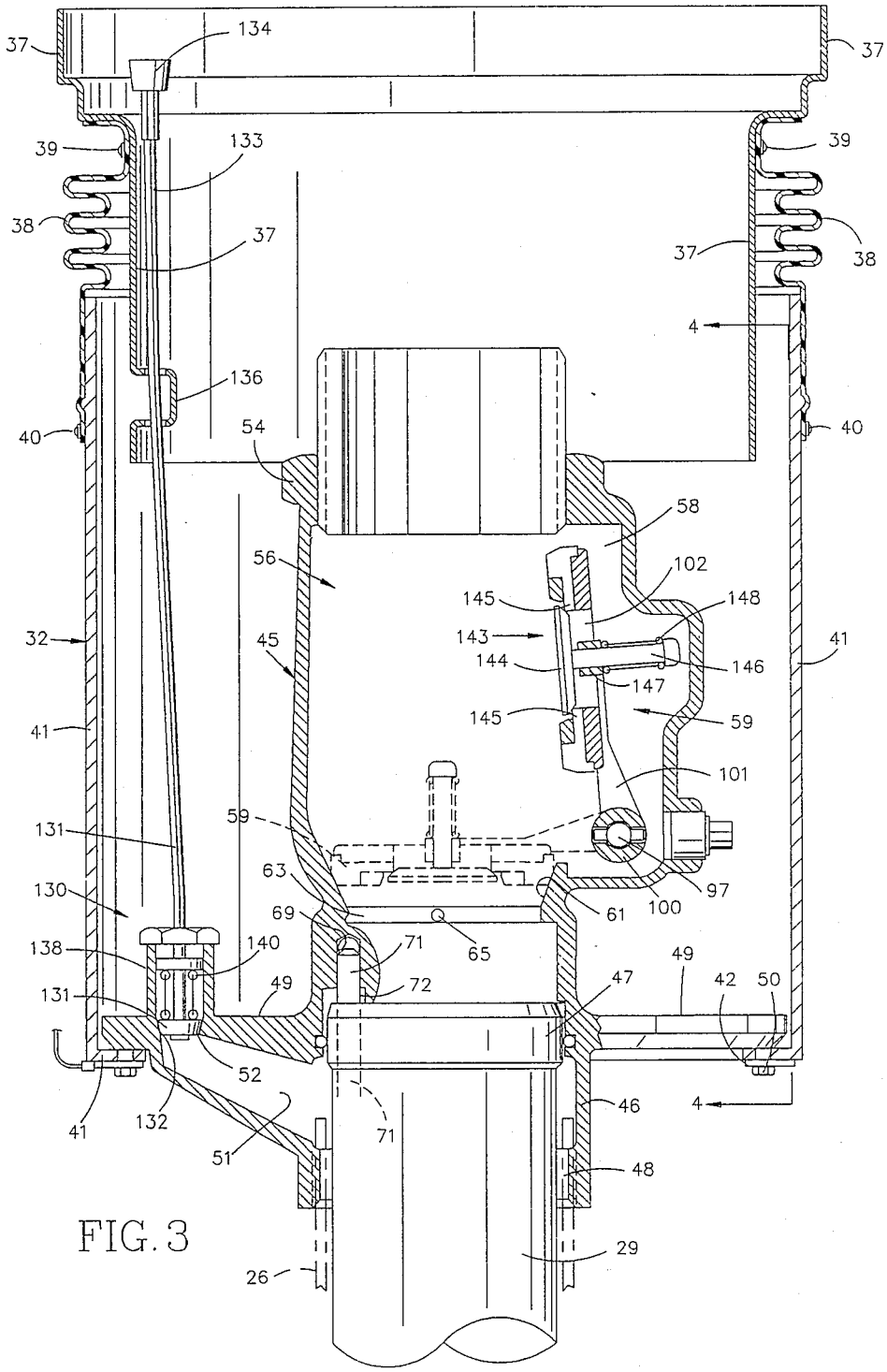
FIG. 3 is a side sectional view of the valve means of the overflow prevention system of FIG. 2.

The top of the body 45 has a fitting 54 for connection to the adapter 24 which can be connected to the coupler of the fill hose from the tank truck. Extending from the adapter fitting 54 to the drop tube fitting 48 is a liquid fill passage 56 which extends through the body 45, as shown in FIG. 3. The fill passage 56 includes an upper chamber 58 for valve means 59 which closes the fill passage 56. At the bottom of the chamber 58 is an annular valve seat 61 against which the valve means 59 acts to close the fill passage 56, as shown in broken lines in FIG. 3. Directly below the valve seat 61 is a narrowing throat portion which forms a venturi 63.

As can be seen in FIG. 3, the inner diameter of the fill passage 56 at the venturi 63 is significantly smaller than the inner diameter of the remaining portions of the fill passage 56, so that liquid traveling through the fill passage 56 increases in velocity as it passes through the venturi 63. This increased velocity of the liquid is used to a draw a partial vacuum at the venturi 63 which is used to actuate the valve means 59. The partial vacuum is drawn at a venturi orifice 65 (FIGS. 3 and 5) located on the side of the body 45 at the venturi 63. The partial vacuum drawn at the orifice is normally vented through a series of passages. A cross vent passage 67 extends from the orifice 65 to the side of the body 45. The cross passage 67 is connected to another cross vent passage 69 which extends along the side of the body 45. A level sensing vent tube 71 extends from the end of the cross passage 69 down into the underground liquid storage tank 28. The top of the tube 71 is connected to the body 45 at a fitting 72 located above the drop tube fitting 48. The tube 71 extends downwardly from the fitting 72 along and inside the drop tube 29. The bottom of the tube 71 contains an orifice for venting to the underground liquid storage tank 28. Atmosphere from the underground storage tank is thus drawn through the vent passages to relieve the partial vacuum generated at the venturi orifice. The level at which the bottom orifice of the tube 71 extends into the liquid storage tank 28 is the predetermined fill height of the tank.

The automatic overflow prevent system 30 of the present invention will actuate automatically when the bottom orifice of the level sensing tube 71 is covered and immersed in liquid within the underground storage tank 28 as the tank is filled. When the underground liquid storage tank 28 is filled to the predetermined level, and the bottom orifice of the level sensing tube 71 is covered, the partial vacuum formed at the venturi 63 and sensed at the orifice 65 can no longer be vented through the tube 71. Instead, the partial vacuum drawn at the venturi orifice 65 is used to actuate a latch means 75 to close the valve means 59.

Figure 6:
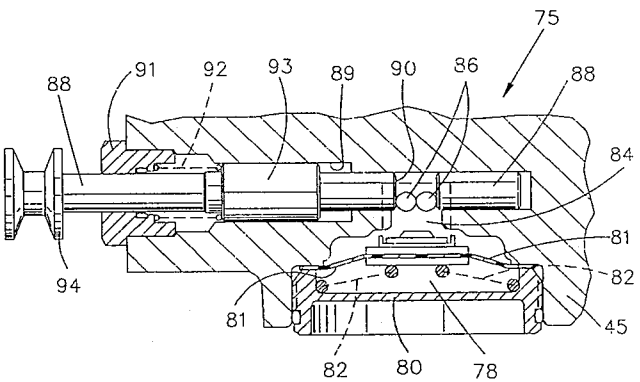
FIG. 6 is a top sectional view of the pressure-responsive latch means taken along line 6—6 of FIG. 5.

The latch means 75 is connected to the orifice 65 by a vacuum passage 76 (FIG. 5) which extends vertically along the side of the body 45. As shown in FIG. 6, the latch means 76 includes a vacuum chamber 78 formed in the side of the body 45 and communicating with the passage 76. The chamber 78 is covered by a cap 80 which extends over the chamber 78 and is attached to the body 45. A diaphragm 81 is held around its periphery between the cap 80 and the body 45. The diaphragm 81 is urged inwardly toward the body 45 by a spring 82 mounted between the diaphragm 81 and the cap 80.

A roller guide assembly 84 is attached to the center of the diaphragm 81. A roller mechanism comprising a pair of rollers 86 is held within the roller guide assembly 84. A stem 88 extends transversely to the roller guide assembly 84 within a corresponding stem passage 89 formed in the body 45. A notch 90 is formed in the stem 88, and the rollers 86 fit within the notch 90 to hold the stem in place. The stem 88 extends outwardly from the body 45 through a plug 91 which covers the open end of the passage 89, and a spool 94 is mounted on the end of the stem 88. The stem 88 is urged inwardly into the stem passage 89 by a spring 92 mounted between the plug 91 and a collar 93 formed on the stem. However, the stem 88 is prevented from moving inwardly into the passage 89 (to the right as shown in FIG. 6) by the engagement of the rollers 86 in the notch 90 formed in the stem.

Figure 4:
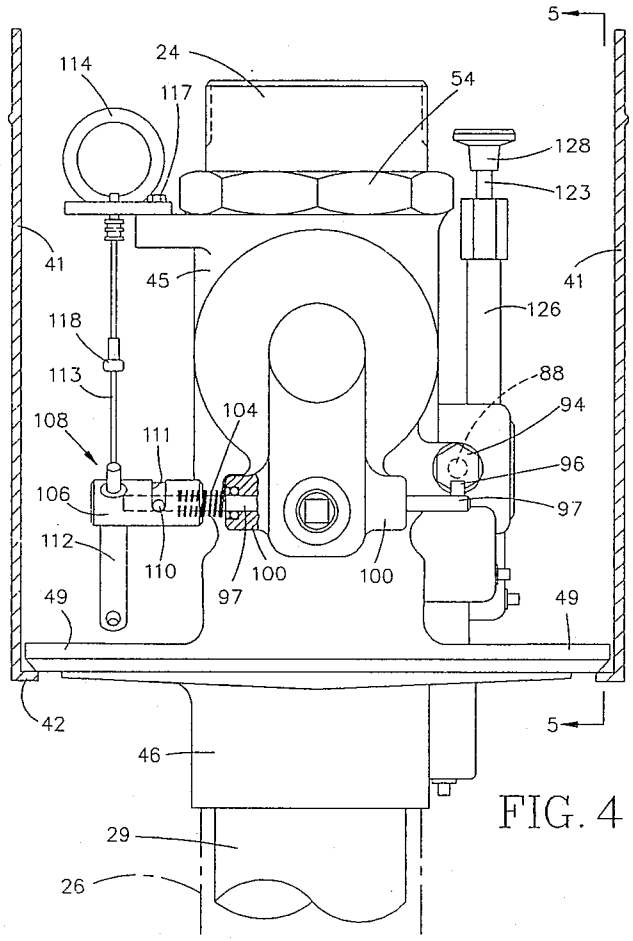
FIG. 4 is a side sectional view of the valve means taken along line 4—4 of FIG. 3.

The spool 94 engages a spur 96 (FIG. 5) located on the end of a pivot shaft 97. The shaft 97 is journaled at each end within a collar 100 formed in the body 45 (FIG. 4) and extends through one side of the chamber 58. The valve means 59 is mounted on the shaft 97 (FIG. 3). The valve means 59 includes an arm 101 which is attached at one end to the shaft 97, and a valve head 102 which is mounted at the end of the arm 101. The valve head 102 is circular and engages the valve seat 61 when the valve means 59 is in the closed position as shown in broken lines in FIG. 3.

The valve means 59, comprising the valve head 102, the arm 101, and the collar 100, are urged into the closed position by a torsion spring 104 (FIG. 4) attached at one end to the collar 100 and at the other end to the shaft 97. However, the valve means 59 is held in the open position by the engagement of the spur 96 on the other end of the shaft 97 with the spool 94. Thus, the engagement of the spur 96 with the spool 94 holds the valve means 59 in the open position in opposition to the torsion spring 104.

When the valve means 59 is closed, the valve means is reopened by a reset assembly 108 (FIGS. 2 and 4) mounted on the outside of the body 45. The reset assembly 108 includes a mounting collar 106 (FIG. 4) around the shaft 97 mounted on the end of the shaft opposite the spur 96. A pin 110 extends from the shaft 97 and engages a slot 111 formed in the collar 106. A pivot rod 112 (FIG. 2) is mounted in the collar 106 and extends to the bottom of an upwardly extending actuating cable 113. At the top of the actuating cable 113 is a ring 114 by which the cable 113 may be pulled upwardly. When the cable 113 is pulled upwardly, the rod 112 causes the collar 106 to rotate. If the valve means 59 is in the closed position, the pin 110 on the shaft 97 engages the slot 111 in the collar 106 as the collar rotates, rotating the shaft 97 and causing the valve means 59 to open. The top of the actuating cable 113 is held by a mounting plate 116 attached to the top of the body 45 by a bolt 117. The cable 113 includes a stop 118 which can be selectively engaged with the plate 116 to hold the valve means 59 partially open, as is normally necessary to drain the tank truck fill hose at the end of the filling operation.

The automatic overflow prevention system 30 of the present invention includes a testing mechanism by which the actuation of the mechanism may be tested bo assure that it is operating properly. The testing mechanism includes a plug 120 (FIG. 5) which engages a test seat 121 located at the connection of the cross passages 67 and the cross passage 69. When the plug 120 engages the seat 121, it prevents the partial vacuum drawn at the venturi orifice 65 from being vented through the cross passage 69, through the tube 71, and through the underground storage tank 28. This causes the latch means 75 to actuate and close the valve means 59. The plug 120 is located at the end of a test rod 123 and is urged upwardly away from the seat 121 by a spring 124 located between the seat 121 and the plug 120. The rod 123 is mounted within a cylindrical sleeve 126 attached to the exterior of the body 45. The top of the rod 123 is provided with a test button 128 which extends outwardly from the sleeve 126 at the top of the body 45. When the buttom 128 is engaged to push the rod 123 downwardly, the plug 120 engages the seat 121 to actuate the testing mechanism.

With the valve means 59 closed, vapor in the underground storage tank 28 is prevented from escaping through the drop tube 29 and through the fill passage 56 formed in the body 45. However, vapor could still escape through the riser 26 and through the drain 51 formed in the manhole bottom 49. To prevent the escape of this vapor, and to selectively allow for the drainage of any accumulated liquid in the manhole into the riser 26, a drain plug assembly 130 is provided. The drain plug assembly comprises a plug 131 which engages a corresponding seat 132 formed around the opening 52 in the manhole bottom 49. The plug 131 is connected to a rod 133 which extends upwardly from the drain. A handle 134 is provided on the top of the rod 133. The rod 133 is held by a bracket 136 formed in the upper manhole sleeve 37. The plug 131 moves within a screen 138 attached to the manhole bottom 49. The screen 138 prevents the drainage of any foreign objects dropped into the manhole, such as leaves or the like, into the riser 26 through the drain 51. The plug 131 is urged downwardly into engagement with the seat 132 by a spring 140 mounted within the screen 138. The plug 131 is pulled away from the seat 132 to allow the drainage of liquid into the drain opening 52 by pulling the handle 134 and moving the plug 131 upwardly in opposition to the spring 140.

As shown in FIG. 3, the valve head 102 is also provided with a relief poppet 143. The relief poppet 143 comprises a poppet head 144 located in the center of the valve head 102 and engaging a poppet seat 145 around the periphery of the head. 102. The poppet head 144 is attached to a poppet stem 146 extending from the head and held in a collar 147 attached to the valve head 102. A spring 148 is provided between the collar 147 and the top of the stem 146 to urge the poppet head 144 into engagement with the seat 145. When hydraulic shock is encountered, such as is present when the valve means 59 is suddenly closed, the shock causes the poppet head 144 to momentarily move away from the seat 145 in opposition to the spring 148, to relieve the shock. After the shock is relieved, the spring 148 returns the poppet head 144 back into engagement with the seat 145.

The operation of the automatic overflow prevention system of the presention invention begins when the tank truck operator arrives at the service station to fill the underground storage tank 28. The operator removes the lid 34 from the manhole rim 33 to provide access to the mechanism 30 located within the manhole. As shown in FIG. 1, the tank truck operator connects the coupler 20 the adapter 24 mounted on the top of the body 45 of the mechanism 30. Since the valve means 59 would normally be closed, the operator first pulls the ring 114 of the reset assembly 108 (FIG. 5) to open the valve means 59. When the ring 114 is pulled upwardly, it causes the actuating cable 113 to pull the rod 112, rotating the collar 106 located on the end of the shaft 97. The slot 111 in the collar 106 engages the pin 110 on the shaft 97, causing the shaft to rotate in opposition to the spring 104 and moving the valve means 59 to its open position. When the valve means 59 reaches the open position, the spur 96 on the end of the shaft 97 engages the outwardly extending spool 94 (FIG. 5) to hold the shaft 97 in position and to hold the valve means 59 in its open position.

With the drain valve assembly 130 (FIG. 2) in its normally closed position, the operator can begin to fill the underground storage tank 28. Filling is accomplished by opening the valve 16 located on the tank truck 14 (FIG. 1), allowing liquid in the compartment 12 to enter the underground storage tank 28 through the filling hose 18, through the fill passage 56 (FIG. 3) formed in the body 45 and through the drop tube 29 which extends down to the underground storage tank 28. As liquid flows through the fill passage 56 of the body 45, it flows through the venturi 63 (FIG. 3) formed in the fill passage. A partial vacuum is created at the venturi orifice 65 located at the venturi 63. This partial vacuum is vented from the orifice 65 by air drawn through the cross passages 67 and 68, and through the tube 71 extending down into the liquid storage tank inside the drop tube 29. Since the bottom end of the tube 71 contains an orifice through which air is drawn from the tank 28, the partial vacuum sensed at the venturi orifice 65 is fully vented as liquid flows through the system.

When the level of the liquid in the underground storage tank 28 rises to the level of the bottom of the tube 71, the bottom orifice of the tube 71 becomes immersed in the liquid and it no longer provides a means for drawing air from the tank to vent the partial vacuum sensed at the venturi orifice 65. When this occurs, a partial vacuum is formed in the vacuum chamber 78 (FIG. 6). The vacuum chamber 78 is connected to the venturi orifice 65 by the passage 76 (FIG. 3). The vacuum in the chamber 78 causes the diaphragm 81 (FIG. 6) to move outwardly away from the body 45 in opposition to the spring 82. This pulls the roller guide assembly 84 away from the body 45 and pulls the rollers 86 out of engagement with the notch 90 formed in the stem 88. With the stem 88 no longer held in place by the rollers 86, the stem moves outwardly from the body 45, urged by the spring 92. Movement of the stem 88 causes the spool 94 (FIG. 3) on the end of the stem to move out of engagement with the spur 96 on the shaft 97. With the shaft 97 no longer held in place by the engagement of the spur 96 with the spool 94, the spring 104 (FIG. 4) causes the shaft 97 to rotate, moving the valve means 59 mounted on the shaft 97 from the open position to the closed position (FIG. 3). The shaft 97 stops moving when the valve head 102 engages the valve seat 61 formed on the inside of the body 45. This rapid closing of the valve means 59 forms a hydraulic shock which is relieved by the relief poppet 43. Upon the closing of the valve means 59, the hydraulic shock causes the poppet head 144 to move downwardly in opposition to the spring 148. After the hydraulic shock is relieved, the spring 148 returns the poppet head 144 to its closed position engaging the poppet seat 145.

Figure 5:
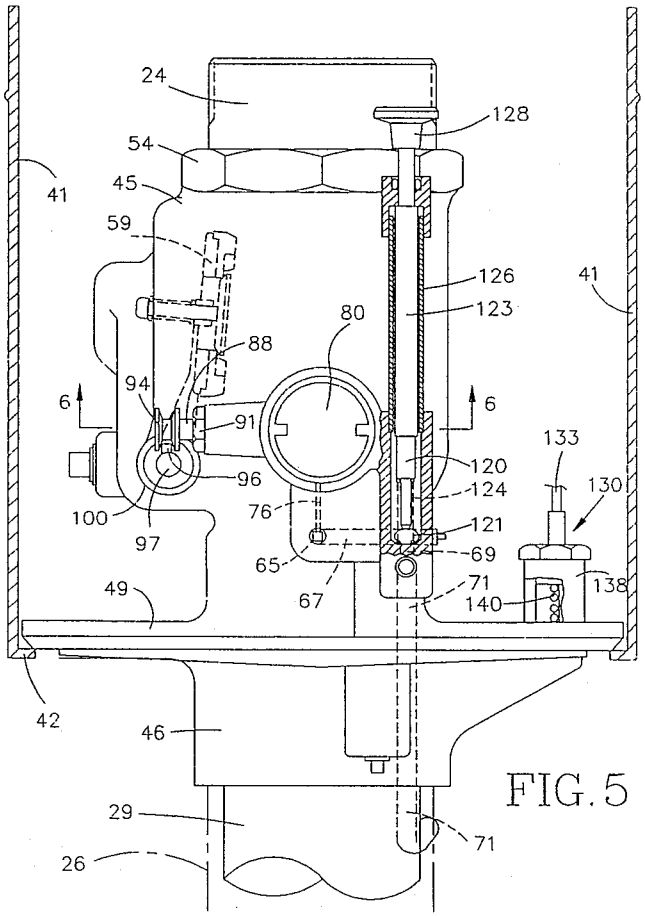
FIG. 5 is a side sectional view of the valve means taken along line 5—5 of FIG. 4.

If the operator wishes to test the latch means 75 and assure that the automatic overflow prevention mechanism 30 is operating properly, this can be acomplished any time that liquid is flowing through the fill passage 56 by engaging the test button 128 (FIG. 5). When the test button 128 is pushed downwardly, the rod 123 moves downwardly, pushing the plug 120 into engagement with the test seat 121 in opposition to the spring 124. This closes the vent passage from the venturi orifice 65 to the tube 71, and prevents the partial vacuum drawn through the orifice 65 at the venturi 63 from being vented normally by air drawn through the tube 71 and from the underground storage tank 28. With the vent passage closed, the vacuum chamber 78 experiences a partial vacuum, moving the diaphragm 81 and closing the valve means 59 as described before. Thus, by pushing the test button 128, the operator can simulate the conditions in the system that occur when the bottom orifice of the vent tube 71 is covered by liquid so that the operator can assure himself that the latch means 75 is operating properly.

After filling the underground storage tank 28, the operator removes the coupler 20 from the adapter 24 and withdraws the filling hose 18 from the manhole assembly 32. When this occurs, any spilled liquid in the manhole can be easily drained into the tank 28 through the riser 26 by means of the drain 51 formed in the manhole bottom 49. To drain the liquid, the operator pulls upwardly on the handle 134, pulling the drain plug 131 away from the opening 52 and allowing the liquid to drain through the drain 51 out of the manhole bottom and into the riser 26.

The drain 51, being integrally cast with the manhole portion 49, is not susceptible to damage during installation, and cannot be inadvertently disconnected. Since the drain 51 is integrally formed with the manhole bottom 49, and since it provides a wide opening into the connection with the riser 26, easy access to the drain is provided, and the drain may be cleaned out without requiring excavation of the entire site, which was necessary with drain hoses of the prior art.

Since the expansion joint 38 is clamped at each end to the upper sleeve 37 and the lower sleeve 41, it is not necessary for the expansion joint to form a movable seal against another portion of the manhole or against the riser pipe, as was required in the containment manhole designs of the prior art. When installed, the expansion joint 38 is accordion-folded as shown in FIG. 3. This allows for substantial axial movement of the mechanism 30 with respect to the manhole rim 33. In addition, because one side of the expansion joint 38 may be moved axially while the other side may not, substantial radial movement of the mechanism 30 with respect to the manhole rim 33 is accommodated by the expansion joint 38. The expansion joint 38 thus isolates the riser 26 from the grade in which the manhole rim 33 is anchored, so that frost heave, and even mild seismic shock, will not rupture the manhole or cause damage to the riser 26 or to the underground storage tank 28. Since the expansion joint 38 provides for radial movement of the manhole rim 33 with respect to the mechanism 30, the transmission of stress ot the underground tank 28 through the riser pipe 26 is prevented.

Various modifications to the preferred embodiment already described are possible. For example, the overflow prevention system mechanism already described may be modified to accommodate fill systems incorporating coaxial lines in which the inner line provides the liquid flowing from the tank truck to the underground storage tank and the outer passage provides a return for vapor displaced from the underground storage tank. For such a system, a peripheral vapor line may be provided on the outside of the body connecting with the vapor line from the fill line from the tank truck at the top and connecting to the peripheral vapor line extending from the underground storage tank. The basic operating elements of the mechanism would remain the same.

If desired, a grounding wire 152 (FIG. 2) may be provided to assure that the body 45 is properly grounded to the rim 33. The grounding wire 152 is connected at one end to one of the bolts 50 and is connected to the other end to one of the bolts 36.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. An assembly for gravity filling an underground storage tank from a tank truck fill line, which comprises:

a manhole rim adapted to be located at ground level;

a cylindrical manhole housing located below the rim;

an elastomeric expansion sleeve connecting the rim to the housing;

a body having a liquid fill passage within the housing and below ground level for the passage of liquid under the influence of gravity, the fill passage having a narrowing venturi throat portion, the fill passage adapted to be connected at one end to the fill line from the tank truck and adapted to be rigidly connected at the other end to the liquid storage tank, the body also having a portion forming a manhole bottom rigidly attached to the bottom of the housing;

a drain passage integrally formed in the manhole bottom allowing liquid to drain from the bottom of the manhole into the fill passage;

a drain valve closing the drain passage and capable of being opened to drain liquid in the manhole bottom into the fill passage;

valve means in the fill passage movable between an open position in which the fill passage is open to permit the flow of liquid through the passage and a closed position in which the fill passage is closed to interrupt the flow of liquid to the storage tank;

means for urging the valve means to the closed position;

pressure-responsive latch means for engaging the valve means and releasably locking the valve means in the open position;

a vent passage having one end adapted to open in the storage tank at a predetermined level below the upper end of the tank and the other end communicating with the pressure-responsive latch means; and a vacuum passage communicating between the pressure-reponsive latch means and the narrowing venturi throat position of the fill passage, the flow of liquid through the fill passage causing a partial vacuum to be formed at the narrowing throat portion, the partial vacuum being vented through the vacuum passage and the vent passage when the level of liquid in the liquid storage tank is below the level at which the end of the vent passage opens, the partial vacuum causing the pressure-responsive latch means to release the valve means when the level of liquid in the liquid storage tank rises to close the end of the vent passage, the release of the pressure-responsive latch means causing the valve means to move to the closed position by the urging means.

2. An assembly for gravity filling an underground liquid storage tank as defined in claim 1, wherein the liquid fill passage includes a valve seat which is sealingly engaged by the valve means when the valve means is in the closed position, and the narrowing venturi throat portion is formed at the valve seat.

3. An assembly for gravity filling a liquid storage tank as defined in claim 1, wherein the valve means includes a pressure-responsive relief poppet portion which opens when the pressure of the liquid flow in the fill passage exceeds a predetermined level during the closing the valve.

4. An assembly for gravity filling a liquid storage tank as defined in claim 1, comprising in addition means for testing the pressure-responsive latch means comprising means for manually closing the vent passage.

5. An assembly for gravity filling a liquid storage tank as defined in claim 1, comprising in addition means for manually opening the valve means.

6. An assembly for gravity filling a liquid storage tank as defined in claim 1, comprising in addition an outer housing extending down from the rim outside the manhole housing, the expansion sleeve located in between the manhole housing and the outer housing.

7. An assembly for filling a liquid storage tank as defined in claim 1, wherein the expansion sleeve is accordion-folded to permit substantial vertical movement of the body with respect to the rim.

8. An assembly for gravity filling an underground storage tank as defined in claim 1, comprising in addition a lid supported on the rim.

9. An assembly for gravity filling an underground liquid storage tank from a tank truck fill line, which comprises:

a manhole rim adapted to be located at ground level;

a lid supported on the rim;

an outer manhole housing extending down from the rim;

a cylindrical inner manhole housing located below the rim and spaced inside the outer housing;

an elastomeric expansion sleeve connecting the rim to the inner housing, the expansion sleeve located in the space between the outer housing and the inner housing, the expansion sleeve being accordion-folded to permit substantial vertical movement of the inner housing relative to the rim;

a body having a liquid fill passage within the inner housing and below ground level for the passage of liquid under the influence of gravity, the fill passage including a valve seat, the fill passage having a narrowing venturi throat portion formed at the valve seat, the fill passage adapted to be connected at one end to the fill line from the tank truck and adapted to be rigidly connected at the other end of the liquid storage tank, the body also having a portion forming a manhole bottom rigidly attached to the bottom of the housing;

a drain passage integrally formed in the manhole bottom allowing liquid to drain from the bottom of the manhole into the fill passage;

a drain valve closing the drain passage and capable of being opened to drain liquid in the manhole bottom into the fill passage;

valve means in the fill passage movable between an open position in which the fill passage is open to permit the flow of liquid through the passage and a closed position in which the valve means sealingly engages the valve seat to close the fill passage and interrupt the flow of liquid to the storage tank, the valve means including a pressure-responsive relief poppet portion which opens when the pressure of liquid flow in the fill passage exceeds a predetermined level during the closing of the valve;

means for urging the valve means to the closed position;

means for manually opening the valve means;

pressure-responsive latch means for engaging the valve means and releasably locking the valve means in the open position;

a vent passage having one end adapted to be open in the storage tank at a predetermined level below the upper end of the tank and the other end communicating with the pressure-responsive latch means;

a vacuum passage communicating between the pressure-responsive latch means and the narrowing venturi throat portion of the fill passage, the flow of liquid through the fill passage causing a partial vacuum to be formed at the narrowing throat portion, the partial vacuum being vented through the vacuum passage and through the vent passage when the level of liquid in the liquid storage tank is below the level at which the end of the vent passage opens, the partial vacuum causing the pressure-responsive latch means to release the valve means when the level of liquid in the liquid storage tank rises to close the end of the vent passage, the release of the pressure-responsive latch means causing the valve means to move to the closed position by the urging means; and means for testing the pressure-responsive latch means comprising means for manually closing the vent passage.

* * * * *